US007100920B2

(12) United States Patent
Onstad et al.

(10) Patent No.: US 7,100,920 B2
(45) Date of Patent: Sep. 5, 2006

(54) SCRIPTURE DOMINO GAME

(76) Inventors: Mayme E. Onstad, P.O. Box 97, Forreston, TX (US) 76041; Alvin C. Onstad, P.O. Box 97, Forreston, TX (US) 76041

( * ) Notice: Subject to any disclaimer, the term of this patent is extended or adjusted under 35 U.S.C. 154(b) by 0 days.

(21) Appl. No.: 10/727,683

(22) Filed: Dec. 5, 2003

(65) Prior Publication Data

US 2004/0108657 A1 Jun. 10, 2004

Related U.S. Application Data

(63) Continuation-in-part of application No. 10/141,903, filed on May 8, 2002.

(51) Int. Cl.
*A63F 9/20* (2006.01)
*A63F 1/00* (2006.01)

(52) U.S. Cl. ..... 273/299; 273/272; 273/293; 273/300; 273/302; D21/376; D21/381; D21/391

(58) Field of Classification Search ..... 273/272, 273/299, 293, 300, 302; 434/167, 171, 172; D21/376, 381, 391
See application file for complete search history.

(56) References Cited

U.S. PATENT DOCUMENTS 3,903,617 A * 9/1975 Evans ..... 434/171
4,252,323 A * 2/1981 Levinrad ..... 273/272
5,271,623 A * 12/1993 Torres ..... 273/299
5,697,615 A * 12/1997 Gilbert ..... 273/299

* cited by examiner

*Primary Examiner*—Benjamin Layno

(57) ABSTRACT

A game is provided that utilizes a code caller card that is used to direct each step of play. The code caller card identify passages of the Bible, and are analogous to a "question" that the player in turn must answer. In combination, word tiles are drawn and held by the players, and are used to create an "answer", the answer being the phrase or quote identified by the "question" on the caller card. These word tiles are used in conjunction with previously played tiles. The word tiles can be used with or without a board and on a flat, horizontal surface.

2 Claims, 2 Drawing Sheets

SCRIPTURE DOMINO GAME

RELATED APPLICATIONS

There present invention is a Continuation in Part of U.S. Ser. No. 10/141,903, filed on May 8, 2002.

BACKGROUND OF THE INVENTION

1. Field of the Invention

The present invention relates generally to board games, and in particular to apparatus and methods of play therefor. Specifically, this invention pertains to a board game utilizing passages or quotes from the Bible as the basis for a word identification game.

2. Description of the Related Art

Board games have enjoyed wide popularity for many centuries, for they combine intellectual challenge, socialization and food for the competitive spirit. Many different types of board games have been invented. For example, some board games involve the movement of playing pieces along one or more paths identified on the playing board, according to the rules of the game. Other board games involve the movement of playing pieces by the players between playing positions, according to rules of the game. Chess, checkers, Chinese checkers, and backgammon are such games. In some games, such as SCRABBLE©, playing pieces may be distributed to the playing board by the players during the course of play; in others, such as chess, playing pieces may be removed from the playing board by the players during the course of play. Other games, such as dominos, are readily played on any horizontal surface, but are conveniently described as board games because of the character of play.

The present invention utilizes a code card that is used to direct each step of play. The code card identifies passages of the Bible, and are analogous to a "question" that the player in turn must answer. In combination, word tiles, similar to domino pieces, are drawn and held by the players, and are used to create an "answer", the answer being the phrase or quote identified by the "question" on the caller card. These word tiles are similar in size and shape to conventional dominos, and have an upper surface in which a maximum of three-letter word phrases are formed, each letter being formed of a series of indented "dots" filled with flourescent-reflective paint. In this manner, a variation of the present game can be played under "black-light" lighting conditions.

SUMMARY OF THE INVENTION

It is therefore an object of the present invention to provide a tile game utilizing passages or quotes from the Bible as the basis for a word identification game.

A second object of the invention is to provide a tile game that is simple enough to be played by children.

Another object of the invention is to provide a tile game that requires relatively simple apparatus, namely, a maximum of three-letter word phrases or word tiles.

Still another object of the invention is to provide a board game that admits to variations in the method of play, to provide the players with variety in the game.

Briefly described according to one embodiment of the present invention, a board game of the present invention provides for playing apparatus, comprising a code card and playing pieces, and a method of play therefor, termed Rules of the Game. The playing apparatus and the Rules of the Game were each developed in conjunction with the other, and the two are inseparable.

During the course of play, a caller identifies a passage of the Bible (e.g. "Matthew 5:8"; "Romans 10:13" or the like) from the code card. Having distributed word tiles amongst the players, the player-in-turn must identify the referenced passage (e.g. "Blessed are the pure in heart"; Whosoever shall call upon the name of the Lord shall be saved"; or the like, respectively). Once identifying the passage, the user must create the passages using the word tiles within his or her possession by placing them in succession on the playing surface.

The present invention additionally comprises several variations in the configuration of the playing board, the number of playing pieces, and the Rules of the Game. One such variation would include suitable markers such as pins with raised heads required to provide for a board which can then be used for Braille users.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
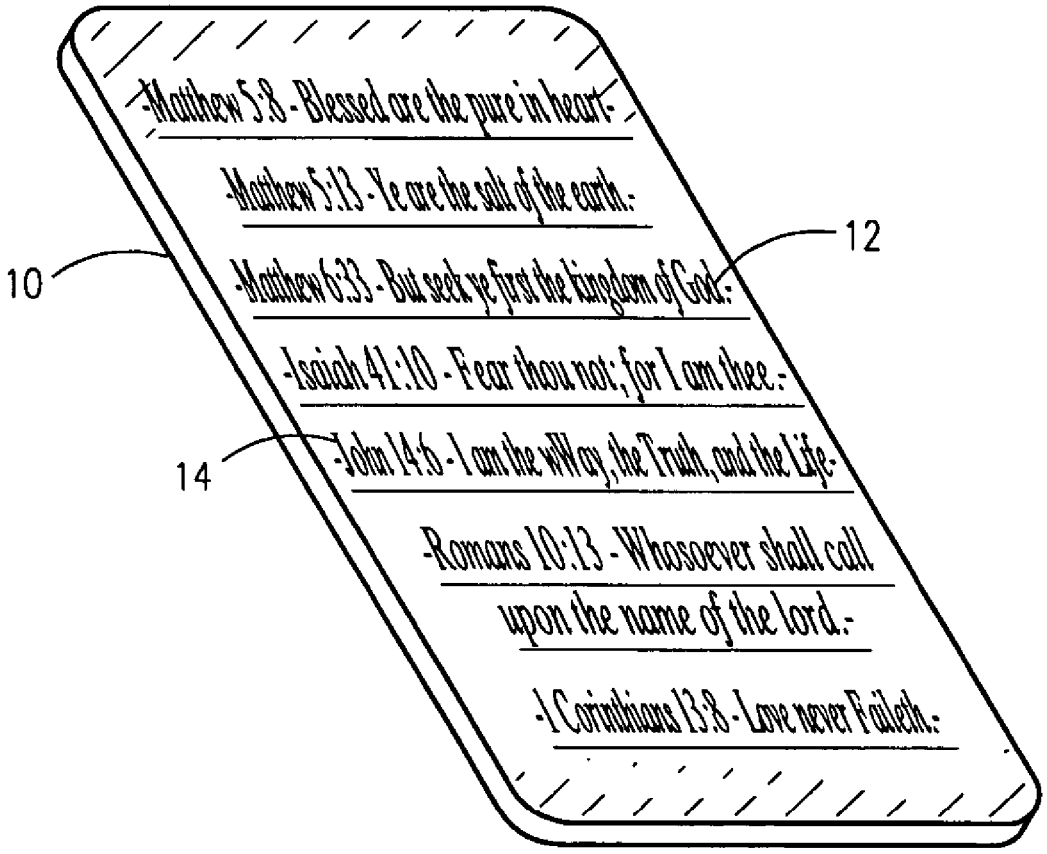
FIG. 1 is a perspective view of a code card for use with the preferred embodiment of the present invention.

The board game of the present invention is conveniently described with reference to the drawings. As shown in FIG. 1, a code card 10 includes a scripture from the Bible 14 and its referenced cite 12. The code card 10 includes seven such scriptures. It is anticipated that these seven scriptures, and the respective referenced cite, would include:

1. Matthew 5:8. Blessed are the pure in heart.
2. Mattew 5:13. Ye are the salt of the earth.
3. Matthew 6:33. But seek ye first the kingdom of God.
4. Isaiah 41:10. Fear thou not; for I am with thee.
5. John 14:6. I am the Way, the Truth, and the Life.
6. Romans 10:13. Whosoever shall call upon the name of the Lord shall be saved.
7. 1 Corinthians 13:8. Love never faileth.

Figure 2:
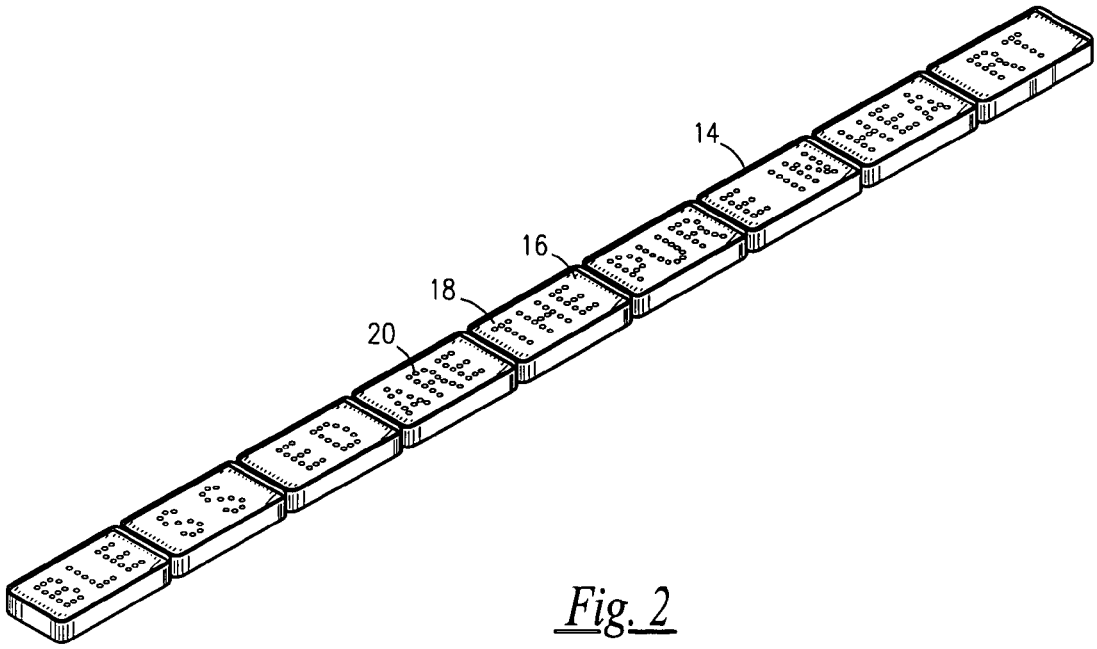
FIG. 2 is a perspective view of word tiles for use with the preferred embodiment of the present invention.

The code card 10 is used to direct each step of play. The code card 10 identify passages of the Bible, and are analogous to a "question" that the player in turn must answer. In combination, word tiles 14, as shown in FIG. 2, similar to domino pieces, are drawn and held by the players, and are used to create an "answer", the answer being the phrase or quote identified by the "question" on the caller card. These word tiles are similar in size and shape to conventional dominos, and have an upper surface 16 in which three-letter word phrases 18 are formed, each letter being formed of a indicia 20 formed as a series of indented "dots" filled with flourescent-reflective paint. In this manner, a variation of the present game can be played under "black-light" lighting conditions.

In an alternate embodiment, the word tiles are indicated with suitable markers such as pins with raised heads may be required to provide for a board which can then be used for Braille users.

The present invention additionally comprises several variations in the configuration of the playing board, the number of playing pieces, and the Rules of the Game.

2. Operation of the Preferred Embodiment

The Rules of the Game are as follows:

a. One person is chosen to call out where the scriptures are found by selecting a cite from the code card 10.
b. All tiles 14 in FIG. 2 are placed face down on the table and shuffled.
c. No player is to see another player's tiles.
d. Each player draws seven tiles.
e. Each player has a turn to try to put the tiles in order to make the scripture correctly.
f. If the player does not have the correct word tiles, his turn is passed and he picks another tile from the pile for his next turn.
g. Players keep taking turns until there has been two rounds; if no one get the scriptures formed from the tiles, then the players can refer to the Bible to identify the scripture.
h. If the player can place his tiles in the right order, he calls out "Domino" and is the winner of the round.
i. The caller checks the code card to verify the answer.
j. Seven rounds are repeated.
k. The player that wins the most rounds is the winner of the game.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. A method of play for a game, comprising acts performed according to the following sequence:

providing a plurality of player pieces comprising word tiles, said word tiles comprising three sets of word tiles, first set of word tiles, each word tile from said first set of word tiles having a plurality of letters forming only a portion of a word on the word tile, a second set of word tiles, each word tile from said second set of word tiles having a plurality of letters forming only one entire word on the word tile, and a third set of word tiles, each word tile from said third set of word tiles having a plurality of letters forming only two words, a first word and a second word, wherein the first word is either the entire first word or a portion of the first word, and the second word is either the entire second word or a portion of the second word;

providing a plurality of code calling cards, each code calling card having a plurality of scriptures cited;

a. forming a group of word tiles face down on a playing surface;
b. choosing a person to handle the code calling cards;
c. identifying scripture cite indicated on a code calling card;
d. drawing of seven word tiles from said group of word tiles by participants;
e. arranging said word tiles to correspond to said scripture cite, wherein when said word tiles are correctly arranged side-by-side said word tiles form a sequence of entire words that correspond to said scripture cite;
f. passing of a player turn if failing to correctly arrange said word tiles to correspond to said scripture cite;
g. drawing of an eighth word tile from said group of word tiles;
h. passing of said player turn if failing to correctly arrange said word tiles to correspond to said scripture cite after drawing said eighth word tile;
i. drawing a ninth word tile from said group of word tiles;
j. passing of said player turn if failing to correctly arrange said word tiles to correspond to said scripture cite after drawing said ninth word tile;
k. referring to a Bible to identify scripture;
l. arranging said word tiles to correctly correspond with said scripture cite; and
m. identifying said scripture cite, player-in-turn must place word tiles corresponding to said scripture cite upon playing surface.

2. The method of play of claim 1, wherein said word tiles have an upper surface, said upper surface including word indicia that forms a written word, said word indicia formed of indentations in said upper surface so as to provide better visualization of said word indicia.

* * * * *